US005833506A

United States Patent [19]

Oga et al.

[11] Patent Number: 5,833,506

[45] Date of Patent: Nov. 10, 1998

[54] METHOD FOR MANUFACTURING A FLUORESCENT LAMP

[75] Inventors: Toshiyoshi Oga, Shiga; Masaru Saitoh; Nobuyuki Tsubakihara, both of Osaka; Ikuhiro Okuno, Kyoto, all of Japan

[73] Assignee: Matsushita Electronics Corporation, Osaka, Japan

[21] Appl. No.: 754,208

[22] Filed: Nov. 20, 1996

[30] Foreign Application Priority Data

Nov. 27, 1995 [JP] Japan ..... 7-307089

[51] Int. Cl.[6] ..... H01J 9/26

[52] U.S. Cl. ..... 445/22; 445/26; 65/54; 65/110

[58] Field of Search ..... 445/22, 26; 65/54, 65/108, 110

[56] References Cited

U.S. PATENT DOCUMENTS

| | | | |
|---|---|---|---|
| 4,324,447 | 4/1982 | van der Wolf et al. | 445/26 |
| 4,648,850 | 3/1987 | Lima et al. | 445/22 |
| 4,842,635 | 6/1989 | Spaapen et al. | 65/108 |

FOREIGN PATENT DOCUMENTS

| | | | |
|---|---|---|---|
| 63-49334 | 10/1988 | Japan . | |
| 33827 | 2/1990 | Japan | 445/26 |
| 2-61956 | 3/1990 | Japan . | |
| 4-58137 | 9/1992 | Japan . | |
| 6-203798 | 7/1994 | Japan . | |

*Primary Examiner*—Kenneth J. Ramsey
*Attorney, Agent, or Firm*—Merchant, Gould, Smith, Edell, Welter & Schmidt, P.A.

[57] ABSTRACT

Two arc tubes which are to be connected are held at different levels. Predetermined portions in the vicinity of an end of each arc tube are evenly heated and softened by a flame of a burner from the side. An air flow is supplied to blowing up the softened portion to form a semi-junction bridge having a circular cross-section and a flat connecting face. The thickness of the wall of the semi-junction bridge is even. The arc tubes having the semi-junction bridges are disposed on the same plane and one arc tube is moved to the other to connect the semi-junction bridges while the connecting faces are softened.

2 Claims, 7 Drawing Sheets

METHOD FOR MANUFACTURING A FLUORESCENT LAMP

FIELD OF THE INVENTION

This invention relates to a method for manufacturing a fluorescent lamp having a configuration that a plurality of substantially circular or substantially C-letter shaped arc tubes respectively having different inner diameters of the circular shape or the C-letter shape are coaxially disposed on the same plane, and the insides of the adjoining two arc tubes are formed to communicate by a junction bridge.

DESCRIPTION OF PRIOR ART

Generally, a circular fluorescent lamp, formed circularly or formed in a C-letter shape by bending a straight bulb with electrodes at both ends thereof, is mainly used for residence illumination. Illuminating equipment, in which at least two circular fluorescent lamps having different inner diameters of the circular shape are disposed in parallel with each other on different levels, are popularly used for obtaining a high luminous flux. In the conventional illumination equipment, however, the circular fluorescent lamps are disposed on uneven levels, so that the thickness of the illumination equipment from the ceiling is higher, and the size of the illumination equipment is larger. Furthermore, in the conventional illumination equipment, a plurality of the fluorescent lamps are lighted at the same time, so that consumption of electric power by the equipment is greater. The conventional illumination equipment is not economical further in view of the price of the fluorescent lamps. Still furthermore, the degree of freedom for designing the illumination equipment is restricted by the disposition of the fluorescent lamps.

For solving the problems of the conventional illumination equipment, an improved fluorescent lamp and illumination equipment using the lamp are proposed, for example, in Publication Gazettes of Unexamined Japanese Patent Application Hei 2-61956, and Hei 6-203798. In the improved conventional fluorescent lamp, a plurality, for example, of two substantially circular or substantially C-letter shaped arc tubes (herein after abbreviated as circular arc tube(s)) are coaxially disposed on the same plane, and the arc tubes are connected by junction bridge(s). The insides of the arc tubes are communicated by a through hole in the junction bridge (s) in a manner so as to form a discharge path.

It, however, is found that leakage, crack or the like occurs easily in the junction bridge of the improved conventional fluorescent lamp. In the manufacturing process of the fluorescent lamp, it is necessary to dispose a plurality of circular arc tubes coaxially on the same plane, and the circular arc tubes are connected by the junction bridge in a gap between the arc tubes. Since the gaps between arc tubes are too narrow, it is difficult to form the junction bridge between the arc tubes by using a burner. The welding process of the junction bridge is very difficult. Thus, leakage, crack or the like readily occurs in the region of the junction bridge.

SUMMARY OF THE INVENTION

An objective of this invention is to provide an improved method for manufacturing the fluorescent lamp by which leakage, crack or the like are restricted in the junction bridge(s) connecting a plurality of substantially circular or substantially C-letter shaped arc tubes.

A method of this invention for manufacturing a fluorescent lamp having a configuration where a plurality of arc tubes having substantially circular or substantially C-letter shape of different inner diameter are coaxially disposed on the same plane; the arc tubes are connected by junction bridge(s), and a discharge path is formed from a first electrode provided on an end of the arc tube disposed at the most inside to a second electrode provided on an end of the arc tube disposed at the most outside through the inside of the arc tubes and the junction bridge(s), wherein

- two arc tubes, which respectively have at least one closed end and are to be connected by a junction bridge, are disposed on different levels in a direction perpendicular to a plane including the substantially circular or substantially C-letter shape;
- a predetermined portion of the side wall in the vicinity of the closed end of each arc tube, at which the arc tubes are to be connected, is evenly heated by a burner for softening the predetermined portion;
- an air flow is supplied from the other end of each arc tube for blowing off the softened portion of the side wall in a manner to form a semi-junction bridge protruded outside the arc tube and having a connecting face substantially flat and a through hole having substantially circular section;
- at least one of the arc tubes is moved in a manner to dispose the arc tubes on the same plane while the semi-junction bridge is softened; and
- the semi-junction bridges of the arc tubes are pressed and airtightly connected in a manner to communicate the insides of the arc tubes.

By such the method, two arc tubes, which are to be connected, are held on different levels, for example, in a vertical direction, so that a space sufficient for the burner can be obtained while a predetermined bridging portion of the side wall of each arc tube at which the semi-junction bridge is to be formed is heated by the burner. Especially, the bridging portion of the side wall of the arc tube can be heated by a frame of the burner, for example, from the horizontal direction, so that the bridging portion having substantially circular shape around the center of the semi-junction bridge is evenly heated and softened by the burner. An air flow is blown into the inside of each of the arc tubes for breaking the softened bridging portion of the side walls of the arc tubes. The softened bridging portion of the side walls of the arc tubes swell outside the arc tubes. Finally, the centers of the bridging portions are broken. The semi-junction bridges protrude outside the arc tubes and have substantially circular hollow sections. The thickness of the walls of the semi-junction bridges are substantially even. The ends of the semi-junction bridges are substantially flat. By connecting the semi-junction bridges of the arc tubes, a tubular junction bridge for connecting the arc tubes is formed. The junction bridge also has a substantially circular hollow section for communicating the insides of the arc tubes. Since the thickness of the wall of the junction bridge is substantially even and the connected end faces are respectively flat, any occurrence of leakage or crack is prevented.

In the above-mentioned method, it is preferable that at least one arc tube is moved close to the other arc tube parallel to the plane having the substantially circular or substantially C-letter shape in a manner which makes the gap between the semi-junction bridges of the arc tubes narrower than a predetermined length when the junction bridge is completed; and after that, at least one arc tube is moved distant from the other arc tube in a manner to make the gap between the arc tubes substantially equal to the predetermined distance. Thus, air bladders can be removed from the connection part of the semi-junction bridges.

Furthermore, the thickness of the wall at the connection part of the semi-junction bridges (substantially the center part of the junction bridge) can be made even to that of other parts. In addition, the gap between the arc tubes connected by the junction bridge is made even at any position.

DETAILED DESCRIPTION OF THE INVENTION

Figure 1:
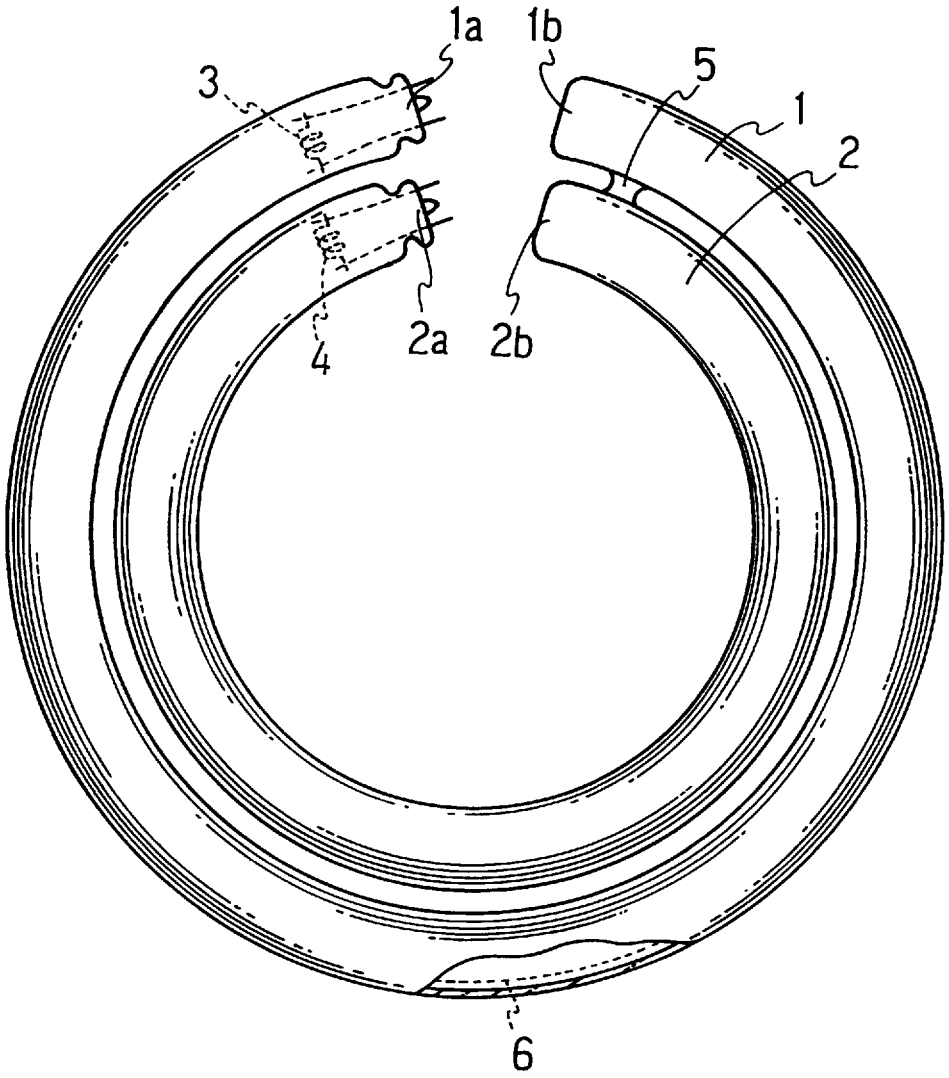
FIG. 1 is a partial cross-sectional front view of a fluorescent lamp which is manufactured by a method of this invention.
Figure 2:
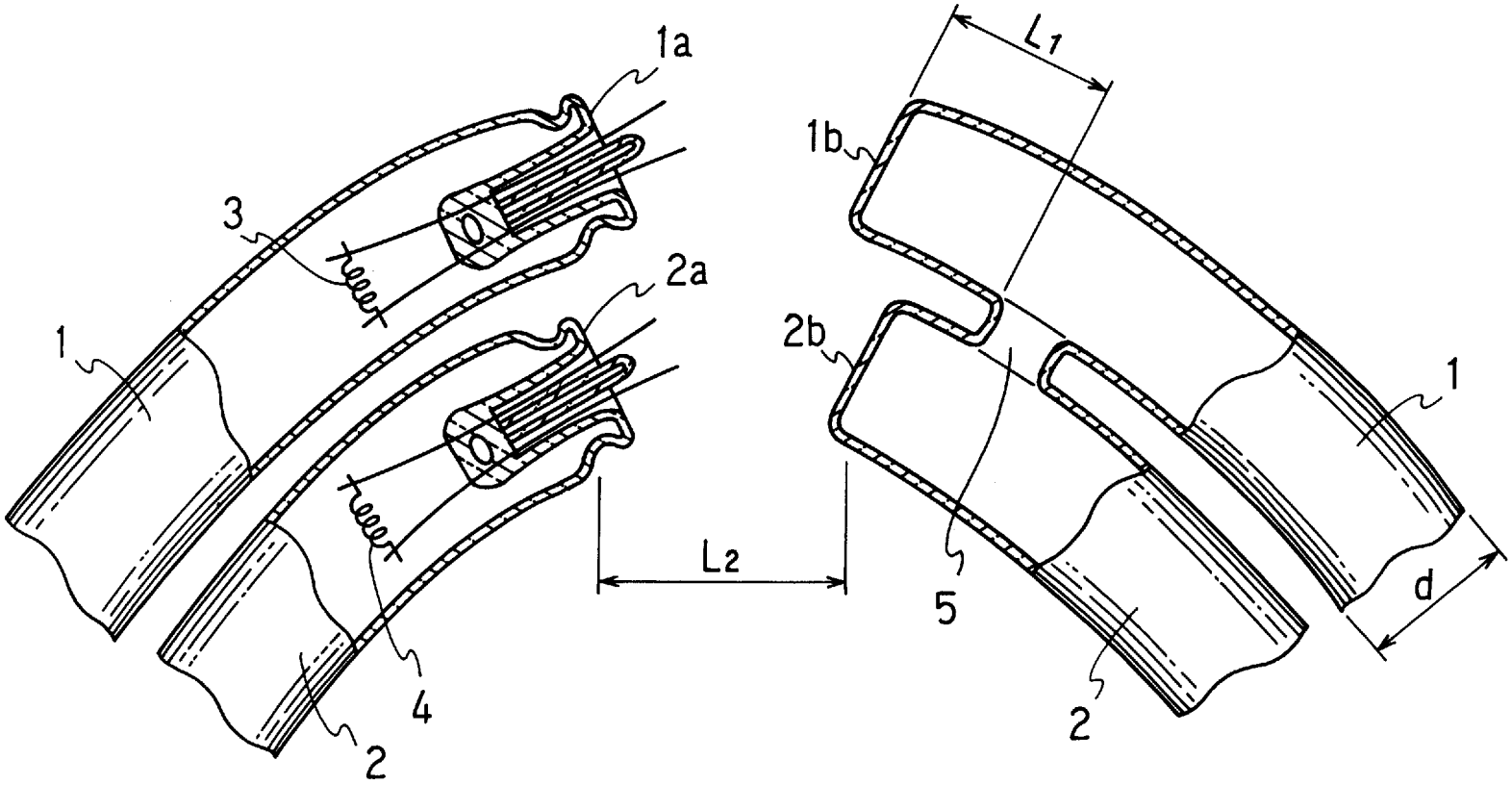
FIG. 2 is an enlarged cross-sectional view showing the details in the vicinity of both ends of the fluorescent lamp shown in FIG. 1.
Figure 3A:
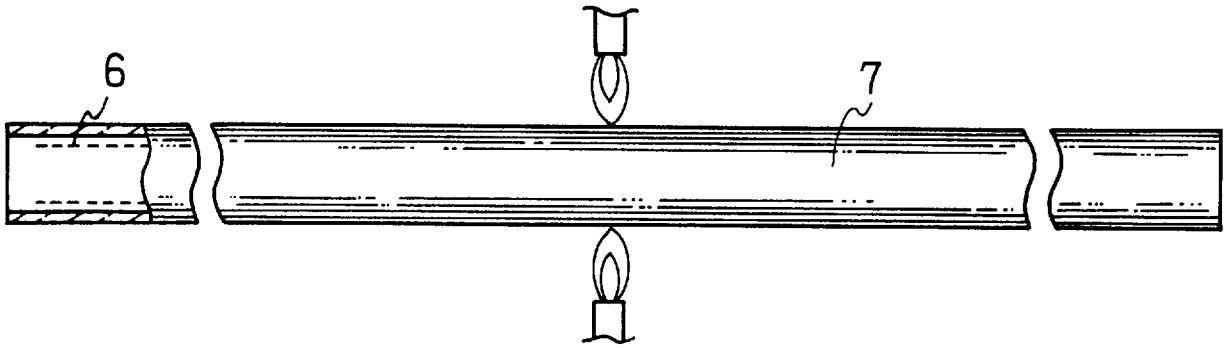
FIGS. 3(*a*) to 3(*c*) are process drawings showing a conventional method for forming arc tubes used in the method of this invention, and especially showing the division of a straight bulb into two parts.
Figure 3B:
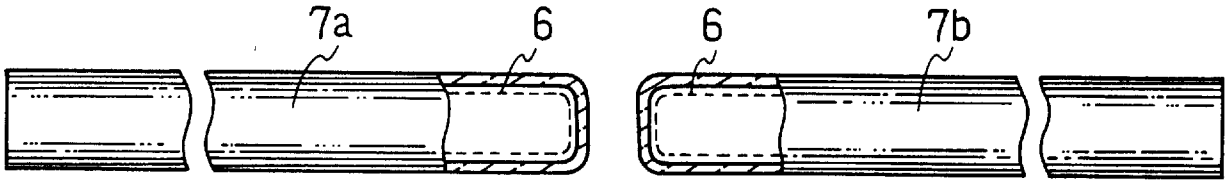
Figure 3C:
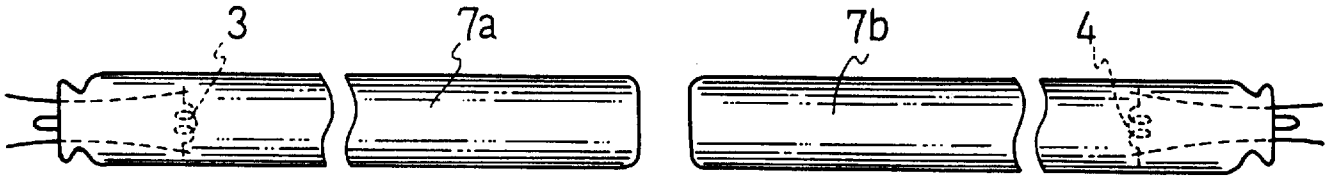

An embodiment of a method for manufacturing a fluorescent lamp of this invention is described referring to FIGS. 1, 2, 3(*a*) to 3(*c*) and 4(*a*) to 4(*e*). At first, a fluorescent lamp which is to be manufactured by the method of this invention is described.

As can be seen from FIGS. 1 and 2, first and second arc tubes 1 and 2, which a have substantially circular or substantially C-letter shape, are coaxially disposed on the same plane. The first arc tube 1 is disposed outside and has a larger inner diameter than the second arc tube 2 disposed inside. Electrodes 3 and 4 are respectively provided on first ends 1*a* and 2*a* of the first and second arc tubes 1 and 2. Second ends 1*b* and 2*b* of the arc tubes 1 and 2 on which no electrode is provided are sealed. The arc tubes 1 and 2 are connected by a junction bridge 5 in the vicinity of the second ends 1*b* and 2*b*. The insides of the arc tubes 1 and 2 are communicated by the junction bridge 5. Thus, a discharge path is formed with the electrode 3 provided on the first end 1*a* of the first arc tube 1, the second end 1*b* of the first arc tube 1, the junction bridge 5, the second end 2*b* of the second arc tube 2 and the electrode 4 provided on the first end 2*a* of the second arc tube 2.

Rare earth phosphor 6 is coated on inner surfaces of the arc tubes 1 and 2. Superfluous mercury and rare gas such as argon, neon or the like serving as a buffer gas at 200–500 Pa are filled inside the arc tubes 1 and 2. Alternatively, mercury can be filled in the form of amalgam alloy of zinc-mercury, bismuth-indium-mercury or the like.

Specifically, a numerical example of the above-mentioned fluorescent lamp is described. An outer diameter of the arc tubes 1 and 2 in a circular cross-section perpendicular to a cross-section having the substantially circular or substantially C-letter shape was 20 mm. The inner diameter of the first arc tube 1 in the cross-section having substantially circular or substantially C-letter shape was 250 mm. The inner diameter of the second arc tube 2 in the cross-section having substantially circular or substantially C-letter shape was 202 mm. A distance L1 from the junction bridge 5 to the center of the second end 1*b* of the first arc tube 1 was 19 mm. A distance L2 between the centers of both ends 2*a* and 2*b* of the second arc tube 2 was 27 mm. When electric power of 68 W having frequency of 50 kHz was applied to the fluorescent lamp, luminous flux of 5500 lm was obtained.

The method for manufacturing the above-mentioned fluorescent lamp of this invention is described in detail. As can be seen from FIG. 3(*a*), a predetermined position a little distant from the center of a straight bulb 7, in which the phosphor 6 is coated on the inner surface of the bulb 7, is heated. As can be seen from FIG. 3(*b*), the straight bulb 7 is divided into two straight bulbs 7*a* and 7*b*. At this time, the ends of the straight bulbs 7*a* and 7*b* are respectively sealed. The method for dividing ones straight bulb into two parts is shown, for example, in Publication Gazette of Japanese Examined Patent Application Hei 4-58137. As can be seen from FIG. 3(*c*), the electrodes 3 and 4 are respectively airtightly fixed on the other ends of the straight bulbs 7*a* and 7*b*. After that, the straight bulbs 7*a* and 7*b* are entirely heated and softened. The straight bulbs 7*a* and 7*b* are respectively wound around circular bending dies (not shown in the figure) in a manner to form the substantially circular or substantially C-letter shaped arc tubes 1 and 2.

Next, as can be seen from FIG. 4(*a*), the first and second arc tubes 1 and 2 are respectively held on different levels in a direction perpendicular to the cross-section having the substantially circular or substantially C-letter shape. Predetermined bridging portions 5*a* and 5*b* of the glass side walls of the arc tubes 1 and 2, in which semi-junction bridges 51 and 52 (shown in FIG. 4(*b*)) are to be formed, are respectively heated by flames of burners 8*a* and 8*b* for softening. Since the first and second arc tubes 1 and 2 are held on the different levels, the flames of the burners 8*a* and 8*b* can be applied to the bridging portions 5*a* and 5*b* of the side walls of the arc tubes 1 and 2 from the side (for example, in the horizontal direction). Thus, the bridging portions 5*a* and 5*b* can be heated and softened evenly.

Under a condition that the bridging portions 5*a* and 5*b* of the side walls of the arc tubes 1 and 2 are softened, air flows are blown into the insides of the arc tubes 1 and 2 from exhausting tubes (not shown in the figure) which are formed on stem parts on the first ends 1*a* and 2*a* of the arc tubes 1 and 2. As a result, the softened bridging portions 5*a* and 5*b* of the side walls of the arc tubes 1 and 2 are swelled outside, and finally broken. Hereupon, the bridging portions 5*a* and 5*b* of the side walls of the arc tubes 1 and 2 are evenly and sufficiently heated and softened, so that the semi-junction bridges 51 and 52, which protrude outside of the arc tubes 1 and 2 by the blowing air, have substantially circular through holes 5*e* and 5*f*. The end faces (connecting faces) 5*c* and 5*d* of the semi-junction bridges 51 and 52 are substantially flat. The thickness of the walls of the semi-junction bridges 51 and 52 are substantially even. The method for breaking the softened side wall of the arc tube by the blowing air is shown, for example, in Publication Gazette of Japanese Examined Patent Application Sho 63-49334.

After forming the semi-Junction bridges 51 and 52 protruding outside the arc tubes 1 and 2, as can be seen from FIG. 4(*c*), at least one of the first and second arc tubes 1 and 2 is moved to be disposed on the same plane as the other. Furthermore, as can be seen from FIG. 4(*d*), at least one of the first and second arc tubes 1 and 2 is moved in a manner to connect the opposing two semi-junction bridges 51 and 52 with each other under the condition that the connecting faces 5c and 5d are softened. The connecting faces 5c and 5d of the semi-junction bridges 51 and 52 are pressed to each other to be connected airtightly. It is necessary to pay attention to connect the semi-junction bridges 51 and 52 while the connecting faces 5c and 5d are sufficiently softened. Thus, it is preferable to make the time short from the breaking of the side walls of the arc tubes 1 and 2 to the pressing the connecting faces 5c and 5d of the semi-junction bridges 51 and 52 (generally less than one second).

Figure 4A:
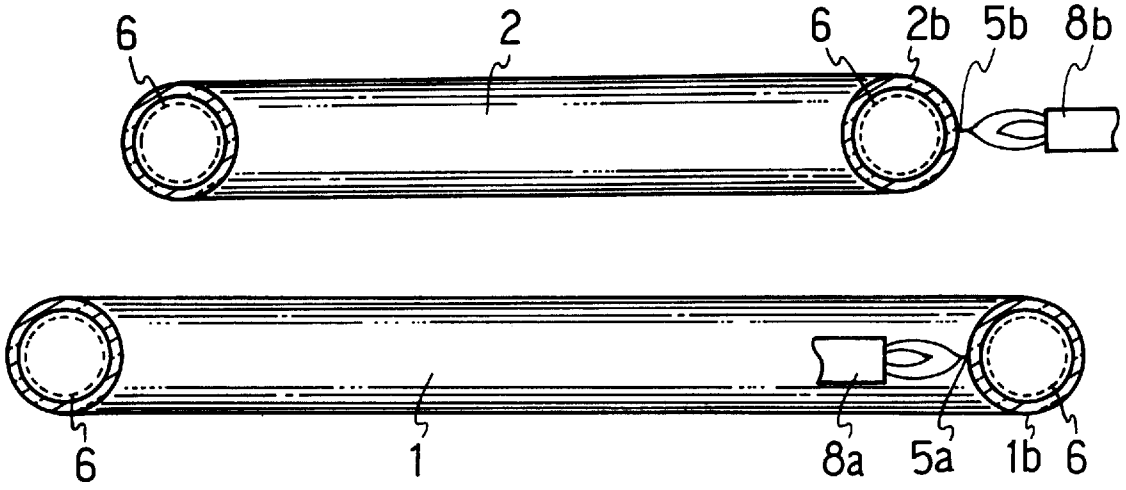
FIGS. 4(*a*) to 4(*e*) are process drawings showing processes for manufacturing the fluorescent lamp of this invention, and especially showing the connection of two circular or C-letter shaped arc tubes.
Figure 4B:
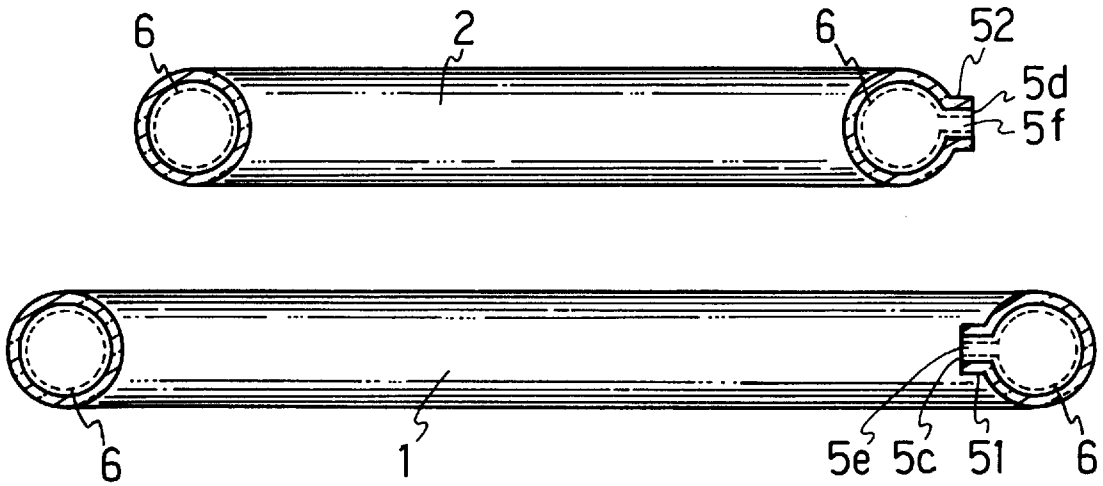
Figure 4C:
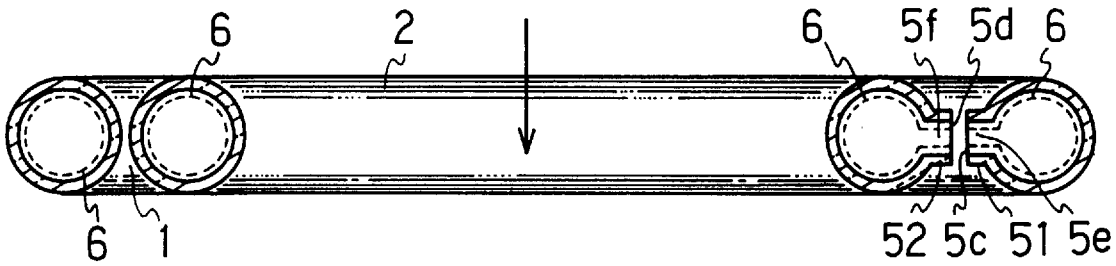
Figure 4D:
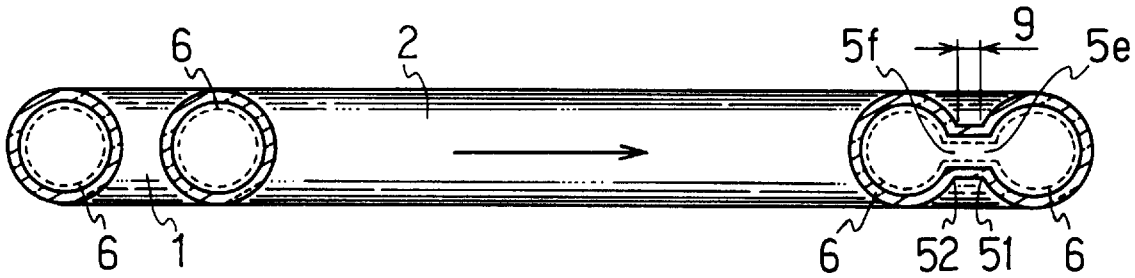
Figure 4E:
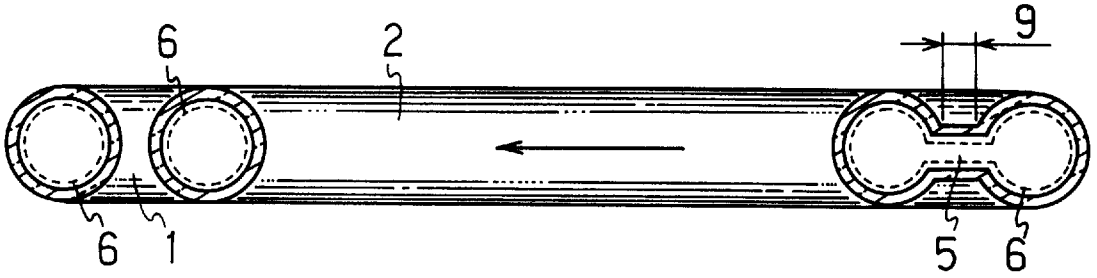

As can be seen from FIG. 4(d), it is important that the gap "g" between the first and second arc tubes 1 and 2 at the position where the semi-junction bridges 51 and 52 are formed is made shorter while the connecting faces 5c and 5d are pressed than a designed original gap when the fluorescent lamp will be completed. Thus, a high quality of junction bridge 5 without leakage or the like can be obtained. More specifically, the inner second arc tube 2 is moved close to the outer first arc tube 1 in a manner to make the gap "g" in a range of 0.3 to 1.5 mm. After that, as can be seen from FIG. 4(e), the inner second arc tube 2 is moved in the opposite direction to expand the gap "g" in a range of 3 to 5 mm. The connected semi-junction bridges 51 and 52 are hardened. As result, junction bridge 5 is formed to have a high quality, in which the thickness of the glass side wall is even and the occurrence of cracking is restricted.

A quality inspection of a fluorescent lamp which was actually manufactured by the above-mentioned method of this invention was executed. The rate of occurrence of leakage or cracking in the junction bridge 5 was less than 0.01%. It was found that the occurrence of leakage or cracking was restricted to a very low level by this invention. In other words, it is found that the above-mentioned method for manufacturing the fluorescent lamp of this invention results in a high quality fluorescent lamp in which a plurality of substantially circular or substantially C-letter shaped arc tubes are coaxially disposed on the same plane and the adjoining two arc tubes are connected by a junction bridge.

Figure 5:
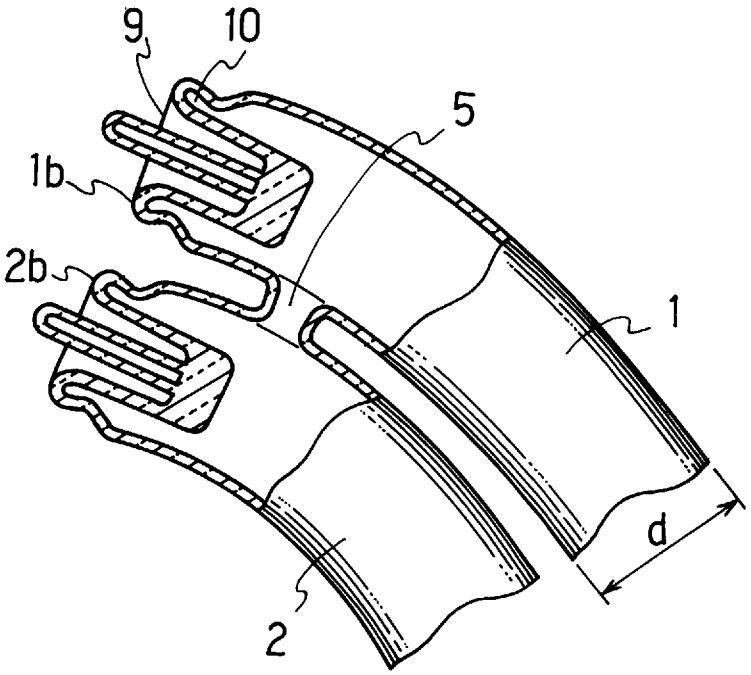
FIG. 5 is an enlarged cross-sectional view showing the details in the vicinity of both ends of another fluorescent lamp which can be manufactured by the method of this invention.
Figure 5:
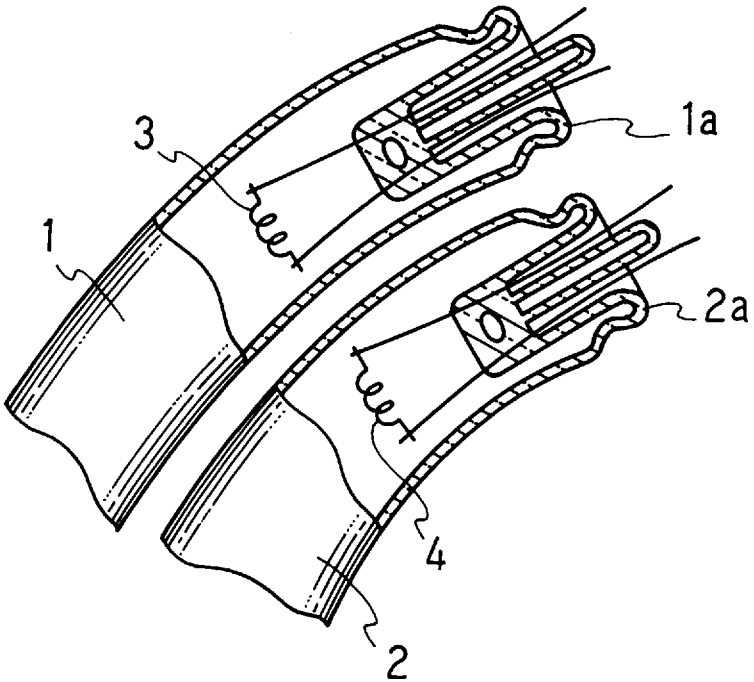

In the above-mentioned embodiment, the straight bulb 7 was cut into two parts 7a and 7b by melting the side wall of the bulb), and the cut ends were formed to be flat for serving as the second ends 1b and 2b of the arc tubes 1 and 2 without the electrodes. However, if the quantity of melted glass material is too little, there is a possibility that the thickness of the sealed end formed to be flat will be thinner than that of the other parts, and that the strength of the sealed end will be reduced. As shown in FIG. 5, it is possible to seal the second ends 1b and 2b of the arc tubes 1 and 2 with stems 9, similar to the first ends 1a and 2a in which the electrodes 3 and 4 are provided. When the ends of the arc tubes are sealed by the stems, the sealing of the ends becomes hard. Furthermore, disadvantages such as cracks in the sealed ends of the arc tubes can be prevented when the straight bulbs are wound circularly or after the fluorescent lamp is completed. Still furthermore, by such a configuration, the ends 10 of the stems 9 are placed at the coldest positions far from the electrodes 3 and 4 in the arc tubes 1 and 2. If the amargam including the mercury atoms is disposed on the ends 10, the vapor pressure of mercury in the arc tubes 1 and 2 can be maintained at an optimum value at the beginning of the lighting of the fluorescent lamp.

For reference, other methods for manufacturing the fluorescent lamp were considered. The results are described.

First reference example

Figure 6A:
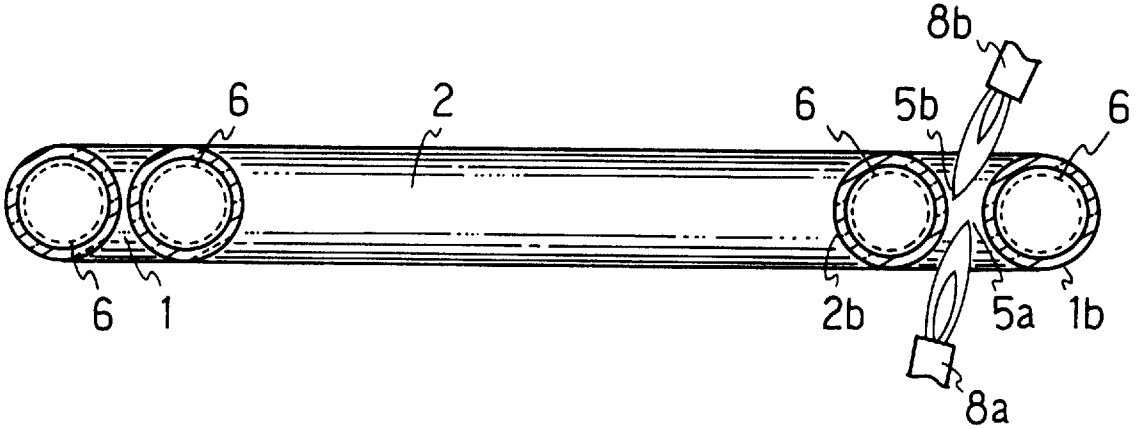
FIG. 6(a) (PRIOR ART)
FIGS. 6(*a*) and 6(*b*) are process drawings of a conventional method for manufacturing the fluorescent lamp.
Figure 6B:
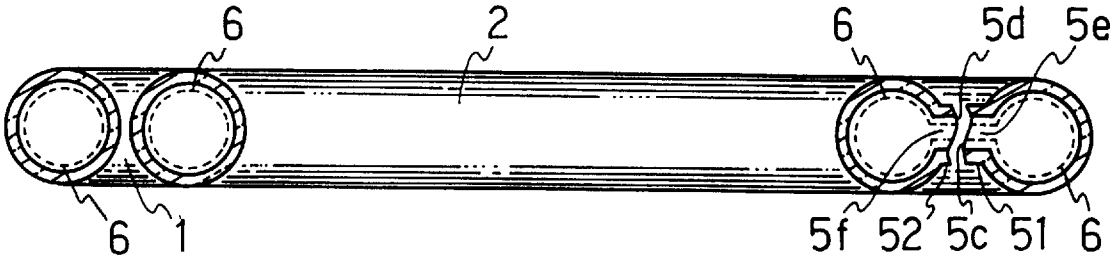
FIG. 6(b) (PRIOR ART)

A conventional method for manufacturing the fluorescent lamp was considered. As can be seen from FIG. 6(a), the first and second arc tubes 1 and 2 were disposed on the same plane. The bridging portions 5a and 5b of the side walls of the arc tubes 1 and 2 in the vicinity of the second ends 1b and 2b, in which the semi-junction bridges 51 and 52 were to be formed, were heated and softened by the burners 8a and 8b. The air flows were blown into the inside of the arc tubes 1 and 2 from the first ends 1a and 2a. Thus, the semi-junction bridges 51 and 52 having connecting faces 5c and 5d were formed, as shown in FIG. 6(b). After that, the connecting faces 5c and 5d of the semi-junction bridges 51 and 52 were pressed against each other for forming the junction bridge 5.

In the conventional method, the first and second arc tubes 1 and 2, however, were disposed on the same plane. The bridging portions 5a and 5b of the side walls of the arc tubes 1 and 2 were heated from above or below by the flames of the burners 8a and 8b, so that the bridging portions 5a and 5b could not be heated and softened evenly. When the kind of the burners and/or the positions of the burners were changed, it was impossible to heat the bridging portions 5a and 5b evenly.

As a result, the shape of the semi-junction bridges 51 and 52 varied widely, and the connecting faces 5c and 5d were not flat. Thus, leakage or the like occurred in the junction bridge 5. It was impossible to form a high quality junction bridge 5. Furthermore, in the fluorescent lamp manufactured by the above-mentioned conventional method, the rate of occurrence of leakage or cracking in the junction bridge 5 was 70–80%.

Second reference example

An other method for forming the fluorescent lamp was considered. At first, as show n in FIG. 4(a), the first and second arc tubes 1 and 2 were respectively disposed on different levels. The bridging portions 5a and 5b of the side walls of the arc tubes 1 and 2 were respectively heated and softened by the flames of the burners 8a and 8b from the sides. Next, as shown in FIG. 4(b), the first and second arc tubes 1 and 2 were disposed on the same plane. The air flows were blown into the insides of the arc tubes 1 and 2 from the first ends 1a and 2a for directly forming the junction bridge 5 by forming and connecting the protruded semi-junction bridges 51 and 52 outside of the arc tubes 1 and 2.

In the above-mentioned method of this second reference example, the first and second arc tubes 1 and 2 were disposed on different levels, so that the bridging portions 5a and 5b could be heated and softened evenly and sufficiently. However, the semi-junction bridges 51 and 52 were formed under the condition that the first and second arc tubes 1 and 2 were disposed on the same plane, similar to the conventional method shown in FIG. 6(b). Thus, it was impossible to form the semi-Junction bridges 51 and 52 having the predetermined shape which is suitable for being connected.

Under the condition shown in FIG. 6(b), when the air flows were blown into the inside of the arc tubes 1 and 2, the softened bridging portions 5a and 5b of the side walls of the arc tubes 1 and 2 swelled outside. The gap between the bridging portions 5a and 5b, however, was narrow. The swelled side walls contacted before the semi-junction bridges 51 and 52 having the predetermined shape were formed. The cross-section of the semi-junction bridges 51 and 52 was not circular, the thickness of the walls was not even, and the connecting faces 5c and 5d were not flat. Furthermore, when the through holes 5e and 5f were formed, the air flows blown into the insides of the arc tubes 1 and 2 collided with each other, so that the connecting faces 5c and 5d were not formed flat.

As a result, the shape of the semi-junction bridges 51 and 52 varied widely, and convex and concave surfaces were formed at the connecting surfaces 5c and 5d. The formed semi-junction bridges 51 and 52 were not suitable to be connected. Quality inspection of the fluorescent lamps manufactured by this method was executed. The rate of occurrence of leakage or cracking in the junction bridge 5 was 20–30%.

In the above-mentioned embodiment of this invention, two substantially circular or substantially C-letter shaped arc tubes are connected by the junction bridge. This invention, however, is not restricted to only two tubes. When a fluorescent lamp having three or more arc tubes which are coaxially disposed and connected is manufactured by the method of this invention, occurrence of leakage or cracking in the junction bridges is also prevented.

Finally, it is noted that the invention may be embodied in other specific forms without departing from the spirit and scope thereof. The embodiments In this disclosure are to be considered in all respects as illustrative and not restrictive. The scope of the invention is indicated by the appended claims rather than by the foregoing description, and all changes which come within the meaning and range of equivalency of the claims are intended to be embraced therein.

What is claimed is:

1. A method for manufacturing a fluorescent lamp having a configuration where a plurality of arc tubes with insides and having substantially circular or substantially C-letter shape of different inner diameter are coaxially disposed on the same plane, the arc tubes are connected by junction bridge(s), and a discharge path is formed from a first electrode provided on an end of the arc tube disposed most inside to a second electrode provided on an end of the arc tube disposed most outside through the insides of the arc tubes and the junction bridge(s); wherein placing a plurality of arc tubes, each of which has at least one closed end and is to be connected to adjacent arc tube by a junction bridge, on different levels in a direction perpendicular to a plane including the substantially circular or substantially C-letter shape;

heating evenly with a burner a predetermined portion of a side wall in the vicinity of the closed end of each arc tube, where the arc tubes are to be connected, to soften the predetermined portion;

expanding the softened portion of the side wall with an air flow supplied from a far end of each arc tube to form a semi-junction bridge which protrudes outside the arc tube and has a connecting face substantially flat and a through hole with a substantially circular section;

moving at least one of the arc tubes in a manner to dispose the arc tubes on a same plane while the semi-junction bridges are softened; and pressing the semi-junction bridges of the arc tubes to airtightly connect them together in a manner to communicate the insides of the arc tubes.

2. The method for manufacturing the fluorescent lamp according to claim 1, including moving at least one arc tube closer to the adjacent arc tube parallel to the plane having the substantially circular or substantially C-letter shape to make a gap between the semi-junction bridges of the arc tubes narrower than a predetermined length when the junction bridge is completed; and then moving said at least one arc tube away from the adjacent arc tube to make the gap between the arc tubes substantially equal to the predetermined length.

* * * * *